United States Patent [19]

Hayatdavoudi

[11] Patent Number: 4,670,161

[45] **Date of Patent: * Jun. 2, 1987**

[54] METHOD AND APPARATUS FOR SEPARATING PARTICLES FLUIDLY SUSPENDED IN A SLURRY

[75] Inventor: Asadollah Hayatdavoudi, Lafayette, La.

[73] Assignee: Premiere Casing Services, Inc., Lafayette, La.

[ * ] Notice: The portion of the term of this patent subsequent to May 6, 2003 has been disclaimed.

[21] Appl. No.: 766,704

[22] Filed: Aug. 19, 1985

Related U.S. Application Data

[63] Continuation-in-part of Ser. No. 642,803, Aug. 21, 1984, Pat. No. 4,587,024.

[51] Int. Cl.[4] ..... B04C 5/08

[52] U.S. Cl. ..... 210/739; 210/788; 210/512.1; 209/144; 209/211

[58] Field of Search ..... 210/787, 788, 512.1, 210/512.2, 739; 209/211, 144; 55/413, 345, 346; 162/55; 73/432 PS, 863.21

[56] References Cited

U.S. PATENT DOCUMENTS

| | | | |
|---|---|---|---|
| 3,243,043 | 3/1966 | Thompson et al. | 210/512.1 |
| 3,370,407 | 2/1968 | Morawski | 55/413 |
| 3,764,005 | 10/1973 | Zemanek | 209/211 |
| 4,378,289 | 3/1983 | Hunter | 209/211 |
| 4,511,474 | 4/1985 | Krishna | 210/512.1 |
| 4,544,486 | 10/1985 | Carroll | 210/512.1 |

FOREIGN PATENT DOCUMENTS

| | | | |
|---|---|---|---|
| 125287 | 7/1985 | Japan | 210/512.1 |
| 322220 | 2/1972 | U.S.S.R. | 210/512.1 |

*Primary Examiner*—Richard V. Fisher
*Assistant Examiner*—Wanda L. Millard
*Attorney, Agent, or Firm*—Fleit, Jacobson, Cohn & Price

[57] ABSTRACT

In one embodiment, the cyclone separator includes an adjustable sidearm conduit which selectively receives different strata of particles passing through the radially outer sectors of the cylindrical region defined within the cyclone body. The cyclone separator may further include a traveling cone valve to restrict the size of the lower outlet. The vortex finder of the cyclone may include a vortex side port to extract the heavier particles entrained in the forced vortex received by the intake of the vortex finder. An inner vortex finder tube is further disposed in the passage through the vortex finder. In another embodiment, the traveling cone is replaced by a lower outlet head spaced from the lower outlet and the lower portion of the housing defining the apex of the frustoconical region. A control system may be combined with the cyclone separator to analyze the particles extracted from the various outlets from the cyclone and effect a change of the controllable features of the cyclone such as the position of the sidearm conduit and affecting the size of the lower outlet. A method for separating particles includes establishing a free vortex and a forced vortex within the cyclone and selectively extracting strata of particles traveling in the radially outer sectors in the cylindrical region of the cyclone body.

17 Claims, 15 Drawing Figures

METHOD AND APPARATUS FOR SEPARATING PARTICLES FLUIDLY SUSPENDED IN A SLURRY

BACKGROUND OF THE INVENTION

This is a continuation-in-part application based upon U.S. patent application Ser. No. 642,803, filed Aug. 21, 1984 now U.S. Pat. No. 4,587,024.

This invention relates generally to a method and apparatus for separating different sized particles fluidly suspended in a slurry and, in particular, to separating particles suspended in slurry extracted from oil wells.

During an oil drilling operation, drilling "mud" is injected into the oil well to maintain the pressure therein and for other reasons recognized by persons of ordinary skill in the art. The drilling mud, hereinafter called slurry, is extracted from the oil well on a regular and/or continuous basis. The extracted slurry contains a number of different "contaminants" such as quartz sand and other formation solids suspended in the slurry. The slurry, before injection, includes barite ($BaSO_4$), bentonite or other special clays known to persons of ordinary skill in the art. The desirable components of the drilling mud, i.e., the barite and/or bentonite, can be recycled and utilized in refurbished slurry to be injected into the oil well if the formation solids and particularly the quartz sand is removed from the contaminated drilling mud or slurry.

A number of different methods and apparatus have been developed to separate out the quartz sand and bentonite from the slurry. One known device is a cyclone or centrifugal particle separator which is sometimes called a "hydrocyclone" if water is part of the slurry. The cyclone separator usually includes a cylindrical region into which the contaminated fluid under pressure is tangentially injected, and a frustoconical region adjacent the cylindrical region. The standard cyclone separator includes a sealing member or plate at the one opposite axial end of the cylindrical region. The base of the frustoconical region adjoins the other, opposite axial end of the cylindrical region. A typical hydrocyclone includes an underflow or lower outlet port at the truncated apex of the frustoconical region. Also, the standard cyclone separator includes a cylindrically shaped vortex finder defining an upper outlet port which is in communication with the cylindrical region and which extends through the sealing member at that axial end. Both the lower and upper outlet ports are concentric to the longitudinal axis of the cyclone separator. As utilized herein, the axis of the cylindrical region and frustoconical region is the axial centerline of those geometrically defined shapes. The term "axially inboard" (and "axially outboard") refers to components or items axially positioned closer to (or further away from) the plane normal to the axis of the cylindrical and frustoconical regions which plane intersects the axial midpoint between the axial extent of the combined cylindrical and frustoconical regions.

The injected slurry, carrying the fluidly suspended particles, enters the cylindrical region under a continuous pressure head. The slurry in the cylindrical region swirls about in a spiral-like fashion and enters the frustoconical region. This spiral like motion at the radial outer sectors of the frustoconical region is recognized as the "outer vortex" or the "free vortex" by persons of ordinary skill in the art. The velocity of the particles carried by the slurry in the free vortex is continuously increased due to the increasingly smaller radial dimension within the frustoconical region. A substantially continuous flow of slurry will exit the lower outlet port. However, because of the centrifugal forces developed within both the regions, a flow of slurry develops at the radially inward sectors of the frustoconical region in a helical or spiral-like path directed towards the cylindrical region. This type of flow is called, by persons of ordinary skill in the art, the "inner vortex" or "forced vortex." Also, an air core coaxially develops along the axis in both regions.

Two types of forces act upon the particles entrained or carried by the slurry flowing within the cyclone separator, to with, the drag forces of the liquid acting on the individual particles in the slurry and the centrifugal settling forces which effect the radial positioning of the particles. Therefore, particles having relatively higher drag forces and comparatively lower centrifugal settling forces generally move towards the radially inner sectors of the cyclone due to its defined internal geometric shape and become entrained in the forced vortex and hence are extracted from the cyclone with the forced vortex portion of the slurry via the vortex finder defining the upper outlet port. On the other hand, particles having relatively lower drag forces and comparatively higher centrifugal settling forces generally move to the radially outermost sectors of the cyclone separator and are entrained in the free vortex. Those latter particles are extracted from the cyclone separator via the lower outlet port. As a general statement, the coarser particles or solids experience greater centrifugal settling forces than the finer solids. Hence, known cyclone separators separate particles on the basis of particle size.

Some prior art cyclone separators utilize vortex finders which move axially within the cylindrical and/or frustoconical regions. By axially positioning the vortex finder, one can regulate the amount of overflow or fluid extracted from the cyclone separator via the vortex finder and upper outlet port. In a similar fashion, some cyclones utilize valves which restrict flow through the lower outlet port and hence change the balance of forces within the cyclone body to affect the type of particles entrained within the forced vortex and exiting the upper outlet port via the vortex finder. U.S. Pat. Nos. 3,259,246 by Stavenger and 4,414,112 by Simpson et al. disclose such cyclone separators.

Some cyclone separators include a secondary outlet port, known in the art as a "sidearm," to extract a specified flow of slurry from the internal regions of the cyclone separator at an axially intermediate location. U.S. Pat. No. 2,981,413 by Fitch extracts a flow of slurry from such a sidearm port and reinjects the same into the cyclone and providing additional motive power for the slurry swirling in the cylindrical region of the cyclone separator. Fitch also discloses a dual vortex finder system. U.S. Pat. Nos. 2,418,061 by Weinberger; 3,533,506 by Carr; and 4,097,375 by Molitor disclose side ports extracting a flow of slurry from the frustoconical region. However, each sidearm port in those known cyclone separators is covered by a screen or a permeable or porous media. The screen allows particles of only a certain size to pass therethrough. The porous media allows only fluid to pass therethrough. Also, those sidearm ports are located in the frustoconical region.

In general, the ability of the cyclone separator to segregate particles depends upon the particle size. However, a publication entitled "Theory of Hydrocyclone Operation and its Modifications for Application to the Concentration of Underwater Heavy Mineral Sand Deposits," by A. Hayatdavoudi, published May 15, 1975, discloses that the separation of sand and magnetite, being fluidly suspended in water and having approximately the same particle size but different densities, can be accomplished in a glass bodied, hydrocyclone due to the development of two separate descending spirals, one sand and the other magnetite. Further, it was noted that an adjustable scrapper tube inserted into a sidearm located tangentially to the wall of the hydrocyclone may result in withdrawal of a major portion of the sand and hence the successful concentration and recovery of the magnetite. However, the publication states that the precise location of the head of the scrapper tube depends on a number of mathematical models and on the fundamental operation of the hydrocyclone. Also, it is specifically recognized in that disclosure that the interaction of the many variables of operation within the hydrocyclone does not provide a clear picture of the complicated phenomenon occurring therein.

OBJECTS OF THE INVENTION

It is an object of this invention to provide for a method and apparatus for selectively separating particles suspended in a slurry.

It is another object of the present invention to control the extraction of particles from the cyclone separator based upon a desired particle parameter.

It is a further object of the present invention to provide for a system of automatically obtaining particles having certain parameters based upon the desired parameter and a sensed parameter of the particle extracted from the cyclone separator.

It is an additional object of the present invention to provide a plurality of controllable components which effect the separation of particles by the cyclone separator.

SUMMARY OF THE INVENTION

One embodiment of the cyclone separator includes a body member defining a cylindrical region and a frustoconical region therein. One axial end of the cylindrical region is sealed off and the base of the frustoconical region adjoins the other axial end of the cylindrical region. A vortex finder extends through the sealing member and defines an upper outlet in communication with the cylindrical region. The cyclone separator includes an inlet port, in communication with the cylindrical region, and a lower outlet at the truncated apex of the frustoconical region, wherein both are concentric to the longitudinal axis of the cyclone. A side outlet, in communication with the cylindrical region, is substantially aligned with the tangential streamlines of flow extending from the streamlines of flow within the cylindrical region. A moveable means for receiving, such as a sidearm conduit, is disposed within the side outlet and receives different strata of the slurry passing through the radially outer sectors of the cylindrical region in accordance with the position thereof. A means for restricting the size of the lower outlet is provided to affect the particles entrained in the forced vortex. Also, the vortex finder may include a vortex side port in close proximity to its axially inboard intake.

An apparatus for separating particles fluidly suspended in the slurry includes the cyclone separator and a particle analyzer for sensing a parameter of the particles extracted from various outlet ports in the cyclone separator. For instance, the particle separator could be set to determine the size of the particles received in the sidearm conduit, i.e., the received strata, and generate an appropriate parameter signal. That parameter signal is applied to a means for generating a first control signal in accordance with a desired parameter particle signal (the desired size) and in comparison with the first parameter signal (the actual size) generated by the particle analyzer. The apparatus includes means for positioning the sidearm conduit based upon the first control signal means. Control of the size of the orifice at the lower outlet achieves a desired particle separation in the fluid extracted via the upper and lower outlets.

A method of separating particles includes providing a defined cylindrical and frustoconical region, injecting the slurry under pressure and establishing a swirling movement within the cylindrical region, controllably extracting selected strata of particles at the radially outermost sectors of the cylindrical region, establishing a free vortex and a forced vortex in the frustoconical region, providing for a lower outlet at the truncated apex of the frustoconical region and an upper outlet in the cylindrical region, extracting a first portion of particles via the lower outlet due to the free vortex and extracting a second portion of particles via the upper outlet due to the forced vortex. An analysis of the particles is included with this method to controllably extract particles entrained within portions of the slurry in the cylindrical and frustoconical regions.

In another embodiment of the present invention, an inner vortex finder tube is coaxially disposed in the vortex finder. The intake of the inner tube extends axially inboard beyond the inboard axial end of the vortex finder and includes a tube intake head which is streamline shaped to coincide with the streamlines of flow in the forced vortex. The axial position of the inner tube is adjustable such that different sized particles are withdrawn from the forced vortex dependent upon the axial positioning of the inner tube. The extraction of particles via the inner tube affects the type of particles extracted by the vortex finder. Additionally, a secondary outlet line which includes a secondary head is mounted in close proximity to the output port of the vortex finder. The secondary head further extracts the lighter and finer particles entrained in the flow through the vortex finder outflow. This embodiment also includes a frustoconically shaped, lower outlet head coaxially disposed and spaced from the lower outlet at the apex of the frustoconical region and the housing portion in close proximity thereto. The lower outlet head has a streamlined intake port disposed axially inboard in the lower portion of the frustoconical region and the head extracts smaller sized particles which otherwise would pass through the lower outlet. The lower outlet head replaces the moveable cone which restricts the size of the lower outlet.

BRIEF DESCRIPTION OF THE DRAWINGS

The subject matter which is regarded as the invention is particularly pointed out and distinctly claimed in the concluding portion of the specification. The invention, however, together with further objects and advantages thereof, may best be understood by reference to the following description taken in connection with the accompanying drawings in which:

DETAILED DESCRIPTION OF THE INVENTION

The invention relates generally to a method and an apparatus for separating particles fluidly suspended in a slurry and particularly to a method and apparatus for controllably extracting particles having specified parameters.

Figure 1:
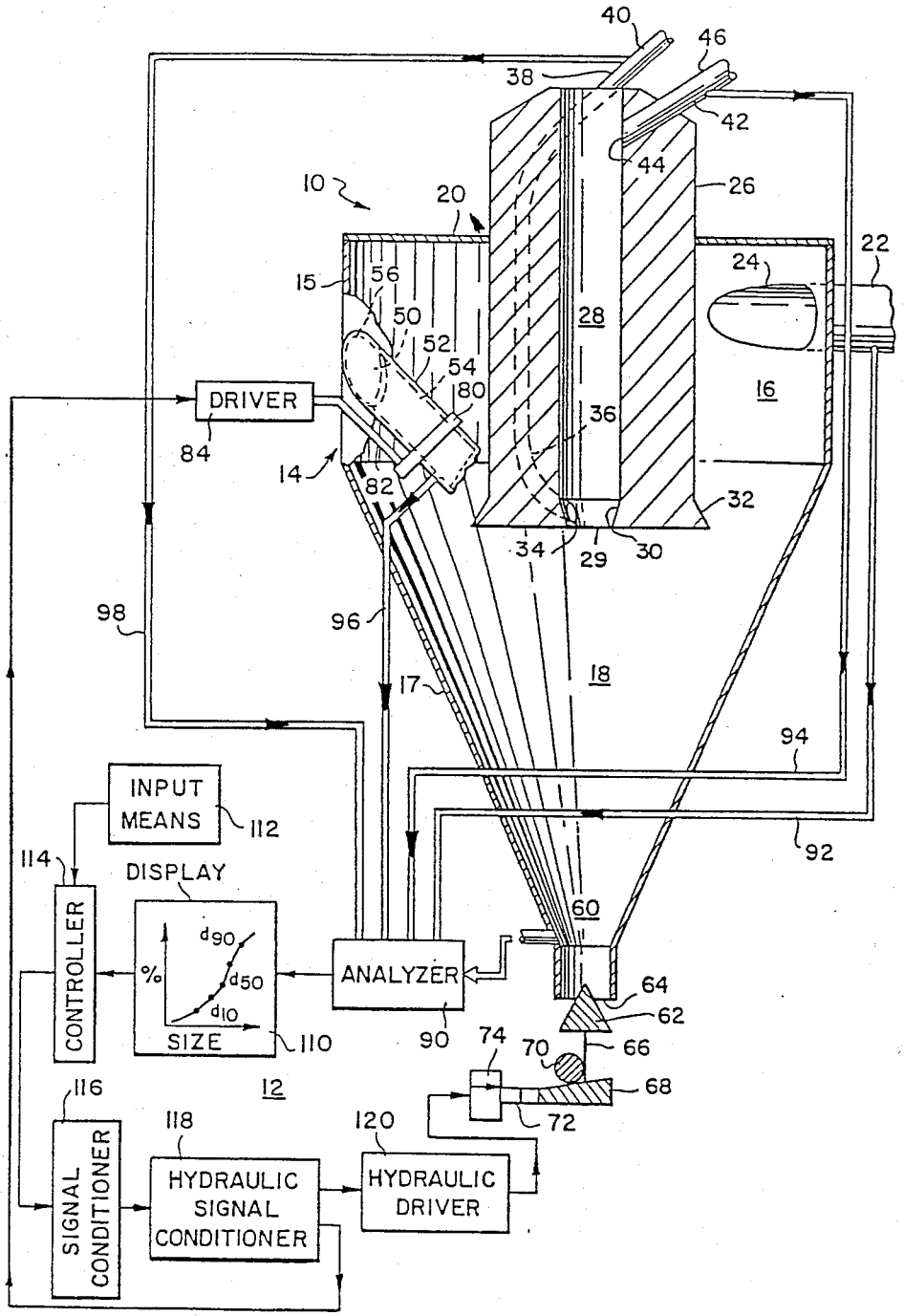
FIG. 1 is a schematic of the cyclone separator in a system for separating particles fluidly suspended in a slurry including a flowchart of a complementary control system.

FIG. 1 schematically illustrates a cyclone separator 10 and a control system 12. A body 14 of cyclone 10 defines a cylindrical region 16 by body portion 15 and a frustoconical region 18 by body portion 17. One axial end of cylindrical region 16 is enclosed by a sealing member or plate 20 and the other axial end of cylindrical region 16 adjoins the base of frustoconical region 18. An input conduit 22 is affixed to body portion 15 and an inlet port 24 is in communication with cylindrical region 16 and input conduit 22. Input conduit 22 and inlet port 24 are substantially tangentially aligned with the interior surface of body portion 15 such that, when slurry is injected under pressure into region 16, the slurry swirls in a generally circumferential manner within cylindrical region 16.

An upper outlet is defined by a vortex finder 26. Vortex finder 26 includes an axially longitudinally extending passage 28 which is concentric with the longitudinal axis of cylindrical region 16 and frustoconical region 18. Vortex finder 26 is substantially cylindrically shaped and passage 28 defines a cylindrical space therein. Vortex finder 26 includes a vortex intake 29 at the axially inboard end thereof. Vortex intake 29 is in direct communication with either said cylindrical region or said frustoconical region, but is illustrated herein as being in direct communication with frustoconical region 18. The cross-sectional area of passage 28 is greater than the cross-sectional area of intake 29 due to taper 30 of the transitional area or region between the intake and the passage. Vortex finder 26 also includes an outer taper 32 at the axially inboard end along the radially outermost portions thereof. In close proximity to intake 29 and in the vicinity of taper 30, vortex finder 26 includes a vortex side port 34 and a spiral, side port passageway 36 extending substantially parallel to the axis of vortex finder 26 and parallel to longitudinal passage 28 therethrough. As illustrated, the passageway is only a partial spiral about vortex finder passage 28. Passageway 36 includes exit port 38. Vortex side port conduit 40 is affixed to vortex finder 26 and communicates with passageway 36 coupling vortex side port 34 thereto. Vortex finder 26 also includes sampling passagway 42 which communicates with passage 2 via sampling port 44 and communicates with sampling channel line 46 through an exit port. The mounting of vortex finder 26 onto body 14 the extension thereof through sealing member 20 is well known in the art.

Cyclone 10 includes a side outlet 50 in communication with cylindrical region 16. Side outlet 50 extends through portion 15 of body 14 defining cylindrical region 16. As will be described in detail hereinafter, side outlet 50 is substantially aligned with the tangential streamlines of flow extending from the streamlines of flow within the cylindrical region when the slurry is introduced into that region via inlet port 24. Sidearm housing 52 is affixed to portion 15 of body 14. The interior of sidearm housing 52 is substantially aligned with the tangential streamlines of flow. Also, sidearm housing 52 is angled towards the truncated apex of frustoconical region 18, i.e., in a vertically downward direction assuming cyclone 10 is vertically oriented such that cylindrical region 16 lies above frustoconical region 18. A sidearm conduit 54 is disposed in sidearm housing 52 and is moveable therein. The sidearm conduit is a moveable means for receiving different strata of said slurry passing through the radially outer sectors of the cylindrical region as will be described hereinafter. Sidearm conduit 54 includes intake portion 56 which has a geometric shape substantially similar to the geometric shape of side outlet 50.

The position of sidearm conduit 54 is changed in accordance with drive train means 80 coupled to power transmission means 82 which is operatable by driver means 84. Therefore, driver 84 can rotatably position sidearm conduit 54 to a plurality of positions within sidearm housing 52.

At the truncated apex 60 of frustoconical region 18, a traveling cone valve 62 is disposed in lower outlet 64. Traveling cone 62 controllably restricts the size of lower outlet 64. In this embodiment, traveling cone 62 moves axially inward to restrict the size of lower outlet 64 and axially outward to enlarge the size of the outlet. This axial movement is accomplished by stem 66 riding on positioner wedge 68 and following cam member 70. Wedge 68 is moved to the left and right as shown in FIG. 1 in accordance with the movement of piston rod 72 extending from piston 74.

The control system 12 includes analyzer means 90 which analyzes at least one parameter of the particles supplied thereto. A number of particle parameters are analyzed by analyzer 90 such as particle size, particle density or chemical composition. One such analyzer utilized in the present invention is a Macrotrac Particle Size Analyzer, Model No. 7995-12, by Leeds and Northrup of St. Petersburg, Fla. That particle analyzer can accept and handle up to eight channels of input. In the embodiment schematically illustrated in FIG. 1, four channels are utilized by analyzer 90 to test the input particles for a selected parameter or parameters wherein the input particles are extracted at various points within cyclone 10. For example, the particle size or range of particle sizes of the slurry input via input conduit 22 into the cyclone is determined by analyzer 90 being supplied with a sample of those particles (or signals relating thereto) by sampling channel line 92 coupling that component. In a similar fashion, sampling channel line 94 provides a channel to analyzer 90 from sample conduit 46 carrying a representative sample of slurry flowing through passage 28 of vortex finder 26. Sampling channel line 96 provides a sample taken from sidearm conduit 54 to analyzer 90 and sampling channel line 98 provides sample particles (or representative signals) from vortex side port conduit 40.

Analyzer 90 generates a plurality of parameter signals based on these various input samples from channels 92, 94, 96 and 98. These parameter signals are input into display means 110. Display means 110 is any piece of equipment which is compatible with analyzer 90 to display, e.g., the range of particle size distribution extracted from the various points in cyclone separator 10. Input means 112 enables the operator of cyclone 10 to choose a particular particle parameter to be displayed via display means 110 or to alter the various controllable aspects of cyclone separator 10 by selecting desired particle parameters. The output of input means 112 is supplied to controller 114 as is the parameter signals passed through display means 110 from analzyer 90. Controller 114 operates on the parameter signals and the desired parameter signals and generates control signals based thereon. Additionally, controller 114 could effect the input pressure of slurry injected via input port 24 and input conduit 22 by sensing the pressure therein and effecting the operation of a pump which is not specifically illustrated in FIG. 1. In other words, pressure sensors could be coupled to conduit 22 and additionally to lower outlet 64 and the signals generated thereby could be utilized as additional controlling parameters in the cyclone separator. The effects of variable input pressure and outlet pressure on the operation of the cyclone are well known by persons of ordinary skill in the art. The output of controller 114 is supplied to signal conditioner 116. The output of signal conditioner 116 is applied to hydraulic signal conditioner 118 which converts the electronic signal into a hydraulic fluid control signal in this illustrated embodiment. One hydraulic control signal is applied to hydraulic driver 120 which actuates piston 74. Another hydraulic control signal is applied to driver 84 which effects, in this embodiment, the rotational position of sidearm conduit 54.

It is known in the art to adjust the axial position of vortex finder 26 such that intake 28 is in direct fluid communication with either frustoconical region 18 or cylindrical region 16. U.S. Pat. No. 4,226,708 by McCartney discloses such an axially moveable vortex finder. Therefore, control system 12 could be altered to also change the axial position of vortex finder 26 in addition to the illustrated controllable features disclosed herein. Similarly, it is known to include a controllable valve either at intake 29 or within passage 28 as disclosed by U.S. Pat. No. 3,568,847 by Carr. Therefore, the disclosed controllable aspects of cyclone 10 in FIG. 1 can be expanded by adding such a controllable valve either at intake 29 or within passage 28. In such a manner, controller 112 would generate the requisite number of control signals to effect those controllable features of cyclone separator 10.

Figure 2:
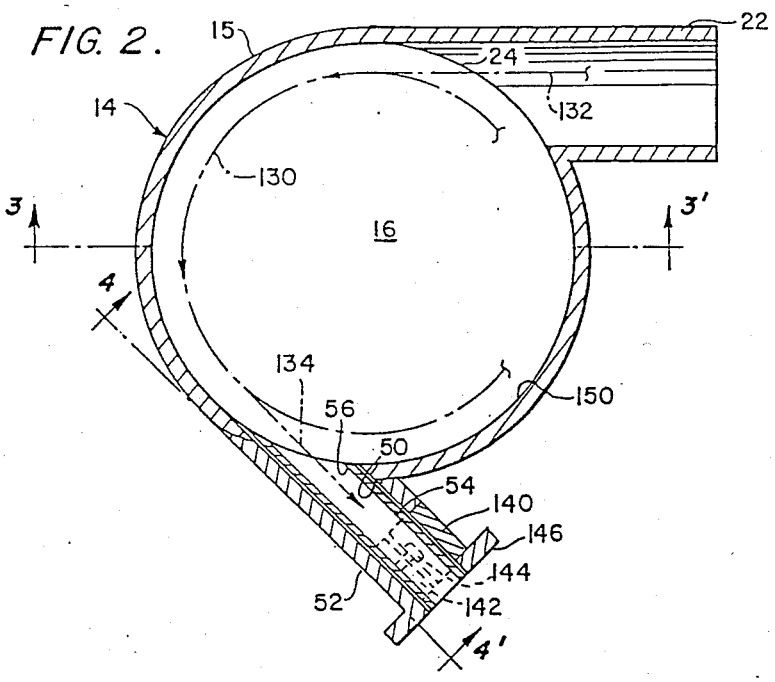
FIG. 2 is a radial, cross-sectional view through the cylindrical region of the cyclone separator.

FIG. 2 illustrates a radial, cross-sectional view of cyclone 10 through cylindrical region 16. Similar numerals designating common elements have been carried forward throughout the figures. FIG. 2 clearly illustrates that input conduit 22, in cooperation with inlet port 24, provides for the injection of slurry into cylindrical region 16 at a tangent with respect to the streamlines of flow within region 16. To illustrate this point, imaginary streamline 130 is partially drawn within cylindrical region 16. Tangent line 132 extends into input conduit 22. In a similar fashion, the sidearm conduit 54 is substantially aligned with tangent line 134 which is tangential to imaginary streamline 130. A person of ordinary skill in the art recognizes that the flow of fluid can be represented by a plurality of streamlines. Therefore, streamlines 130, 132 and 134 are utilized only in an exemplary fashion herein. In the embodiment of cyclone 10 illustrated in FIG. 2, sidearm conduit 54 is immobilized in one position by clamp 140 bolted to flange 142 by bolt 144. In this embodiment, sidearm conduit 54 can be moved both rotatably and along the longitudinal axis of housing 52 by loosening bolt 144 and rotatably or axially moving sidearm conduit 54 within the housing. Also, housing 52 includes flange 146 which is adopted to be connected to complementary piping.

FIG. 2 clearly shows that side port 50 is aligned with the tangential streamlines of flow from the streamlines of flow within cylindrical region 16. Intake portion 56 of sidearm conduit 54 has a substantially similar geometric shape as compared with the shape of side outlet 50. FIG. 2 clearly shows that, in the illustrated position of sidearm conduit 54, intake portion 56 is flush with both side port 50, with interior surface 150 of portion 15 of body 14 and flush with the radially outermost extent of cylindrical region 16 which is defined by surface 150 as well as by side port 50.

Figure 3:
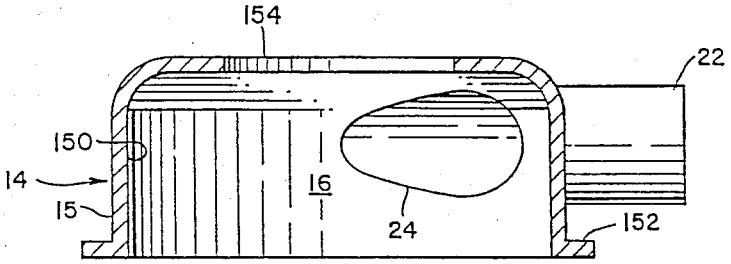
FIG. 3 is a partial, axial, cross-sectional view of the cyclone separator showing the inlet and a portion of the cylindrical region from the perspective of section lines 3—3' in FIG. 2.

FIG. 3 is a partial, axial view from the perspective of section lines 3—3' of FIG. 2. Inlet port 24 is clearly illustrated in FIG. 3 within cylindrical region 16. A flange 152 is utilized to mount this portion of cyclone 10 onto the balance of the cyclone. An opening 154 is noted in the top of the structure illustrated in FIG. 3 for insertion of vortex finder 23.

Figure 4:
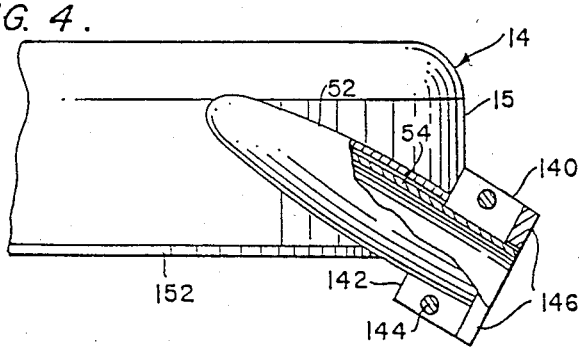
FIG. 4 is a partial, axial view of the exterior of the cyclone separator showing the sidearm housing from the perspective of section lines 4—4' in FIG. 4.

FIG. 4 shows a partial, radially outside, cutaway view of portion 15 of body 14 of the cyclone separator. FIG. 4 clearly illustrates that sidearm conduit 54, as well as housing 52, is angled towards the truncated apex of the frustoconical region which is in the direction of flange 152 below cylindrical region 16.

Figure 5A:
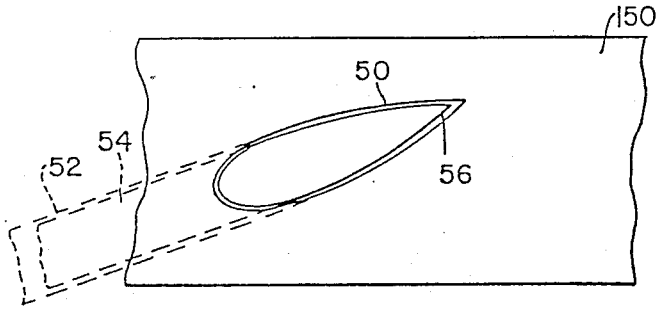
FIGS. 5*a*, 5*b* and 5*c* are plan views of a portion of the interior surface of the cylindrical region proximate the side port and wherein the sidearm conduit is shown at various positions.
Figure 5B:
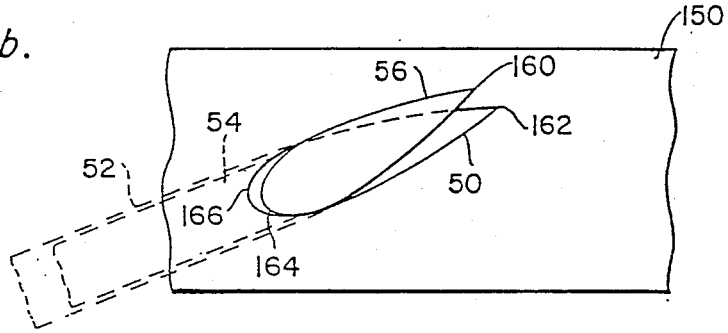
Figure 5C:
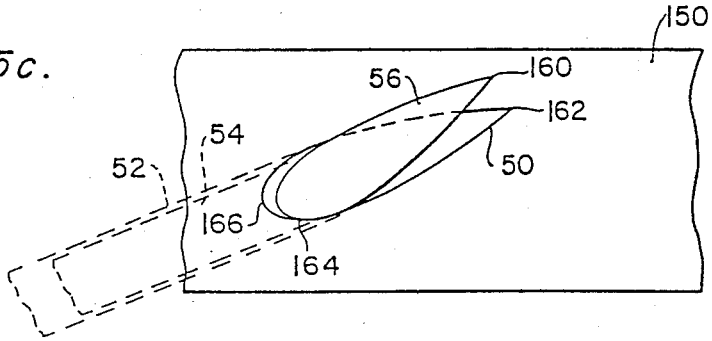

FIGS. 5*a*, 5*b*, 5*c*, 6, 7*a*, 7*b* and 7*c* are plan views of portions of interior surface 150 of body portion 15, i.e., the radially outer sectors of cylindrical region 16. Generally, the set of figures illustrates the operational aspects of the moveable means for receiving different strata of the slurry passing through the radially outer sectors of cylindrical region 16. In FIGS. 5*a*, 5*b* and 5*c*, interior surface 150 is shown with side outlet 50 and intake portion 56 of sidearm conduit 54. In FIG. 5*a*, sidearm conduit 54 is in a first position wherein intake portion 56 is flush with side port 50 and flush with surface 150. FIG. 5*b* illustrates a second position of sidearm conduit 54 wherein the conduit is rotated counterclockwise with respect to the direction flow of fluid traveling through sidearm conduit 54. In this second position, the leading edge 160 of conduit 54 is at an axially outboard position with respect to leading edge 162 of side port 50. As stated earlier, the axially outboard direction is a position axially further from the axial midpoint of the cyclone 10. In other words, leading edge 160 is closer to sealing member 20 than is leading edge 162 when conduit 54 is in the second position. On the other hand, the trailing edge 164 of intake portion 56 is upstream of the trailing edge 166 of side port 50. FIG. *3c* illustrates a third position wherein leading edge 160 of intake portion 56 is extended to a greater axially outboard position than in FIG. *5b* and the trailing edge 164 is further upstream with respect to trailing edge 166. As used herein, the terms "leading" and "trailing" and "upstream" and "downstream" refer to a particular component's position with respect to another component and also with respect to the flow of slurry or fluid passing both those components. It is to be noted that sidearm conduit 54 could be rotated in a clockwise direction with respect to the direction of fluid flow through that conduit. In that situation, leading edge 160 would be at an axially inboard position with respect to leading edge 162 of side port 50.

Figure 6:
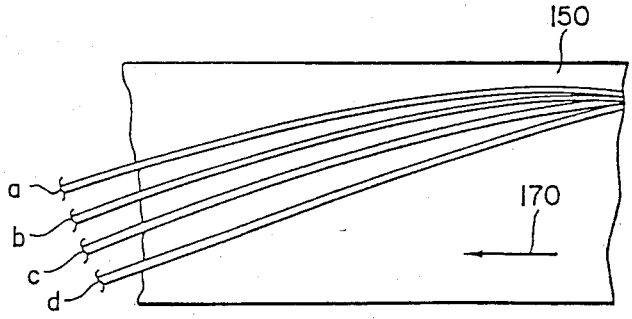
FIG. 6 is a plan view of a portion of the interior surface of the cylindrical region of the cyclone separator showing various particle bands or stratum separated along the interior surface.

FIG. 6 illustrates a plan view of a portion of interior surface 150. FIG. 6 illustrates the phenomenon noted in the earlier study cited above that, in addition to Stokes law defining the gravitational setting of particles towards the walls of the cyclone separator, the particles in close proximity to the interior surface 150 of cylindrical region 16 further separate into strata illustrated as stratum a, b, c and d in FIG. 6. The earlier study disclosed that the particles in close proximity to the wall in the cylindrical region separate into strata generally based upon the particle density. Therefore, the operation of the cyclone in the cylindrical region is similar to a columnar frictional separator. However, a detailed theoretical analysis of this separation mechanism reveals that Stokes law should not apply in the cylindrical region because the applicability of that law assumes (a) that streamline flow conditions occur therein, (b) that there is an unhindered movement of single particles within the flow, and (c) that the law applies to conditions when the forces acting on the particles (the drag forces counteracting the centrifugal "gravitational" forces) are balanced and the law does not apply to the period of particle acceleration prior to the balancing of those two forces. Therefore, it was assumed in the prior art that when large particles are entrained in a high viscosity fluid and are acted upon in a high velocity environment, turbulence alters the factors defining the drag and gravitational forces acting on those larger particles.

The criterion utilized to estimate the velocity at which turbulence occurs is called the Reynolds number. The Reynolds number is generally defined as the density multiplied by the diameter of the particle multiplied by the average velocity and divided by the viscosity of the fluid. The prior art devices assumed that the fluid was incompressible. However, a detailed analysis of the cyclone separator operating on slurry, such as drilling mud, revealed that the fluid is compressible and separates into lamina based upon the radial position of the lamina with respect to the axis of the cylindrical region. Therefore, when the particles in the slurry are in close proximity to surface 150, an additional factor must be incorporated into the calculation of the Reynolds number. That additional factor is called herein "gravitational viscosity" and relates to the great centrifugal force acting on those particles and the lamina of fluid carrying those particles in close proximity to wall 150. Due to the presence of that added factor in the denominator (the viscosity factor) of the Reynolds number calculation, the Reynolds number approaches a very small value and hence the turbulence is substantially reduced at the radially outermost sectors of the cylindrical region, i.e., along interior surface 150 of body 14.

FIG. 6 illustrates, in an exaggerated fashion, the separation of particles into strata or bands along surface 150. It is to be noted that the particles in reality separate into overlapping bands and therefore any one particular stratum is identified based upon the particle parameter of a majority of particles in the particular stratum. Therefore, stratum d in FIG. 6 has a majority of denser particles as compared with stratum a. An important aspect of FIG. 6 to be noted is that each band or stratum of particles travels in an axially inbound direction or towards the truncated apex of the frustoconical region. Also, a particular particle in a certain stratum will move from right to left in FIG. 6 due to the fluid drag forces acting thereon since fluid flow is noted by arrow 170 in that Figure.

FIGS. *7a, 7b* and *7c* are simply an overlay of FIG. 6 onto FIGS. *5a, 5b* and *5c*, respectively. In FIG. *7a*, sidearm conduit 54 is in a first position wherein intake portion 56 is substantially flush with side port 50. In that position, conduit 54 receives a great amount of stratum c. This aspect is noted since stratum c extends from the leading edge of intake portion 56 to the trailing edge thereof and because the particles in stratum c are moving radially outward in accordance with Strokes law, hence more particles of stratum c will circumferentially pass through the breadth of the opening as well as radially encounter intake portion 56. Also, conduit 54 receives portions of stratum b and stratum d. Conduit 54 receives a greater degree of particles from stratum d as compared with the degree of particles received from stratum b because stratum d is completely within the breadth of intake portion 56 whereas stratum b is only partially within the breadth of intake portion 56. A person of ordinary skill in the art recognizes that an analysis of particles extracted via sidearm conduit 54 in the first position would show that the density of the particles or the particle size noted in stratum c would predominate the analysis. Therefore, for purposes of discussion, position 1 is selectable to obtain the particles traveling in stratum c.

FIG. *7b* illustrates the second position of sidearm conduit 54. In this position, leading edge 160 is axially outbound with respect to leading edge 16 of side port 50. In such a position, conduit 54 receives a portion of particles traveling in stratum a, a greater portion of particles traveling in stratum b, a lesser portion of particles traveling in stratum c and a correspondingly lesser portion of particles traveling in stratum d. This phenomenon is noted because the leading edge 160 is axially outbound in comparison with leading edge 162 and also the trailing edge 164 is upstream with respect to trailing edge 166 of side port 50. In other words, stratum b now crosses the breadth of intake portion 56 and hence the particles traveling in stratum b would dominate the analysis of the total particles received by sidearm conduit 54. A person of ordinary skill in the art appreciates that the lighter density particles traveling in stratum a as compared with the density of particles traveling in stratum d also affect the particle distribution analyzed in the sidearm conduit 54. In a similar fashion, a smaller amount of particles in stratum d will be received by conduit 54 due to the short coverage of that stratum by intake portion 56. This second position is selectable to obtain particles which are less dense than those particles extracted when conduit 54 was positioned in the first position.

Figure 7A:
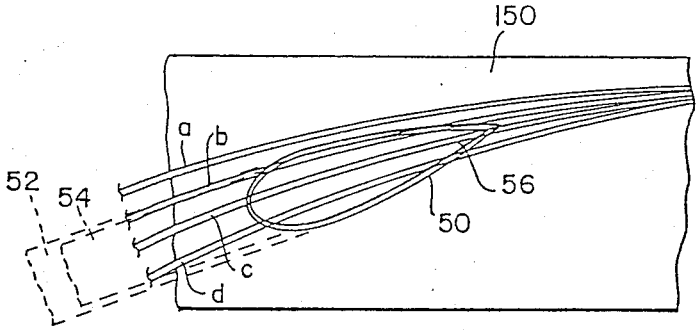
FIGS. 7*a*, 7*b* and 7*c* combine the plan views of FIGS. 5*a*, 5*b* and 5*c* with FIG. 6.
Figure 7B:
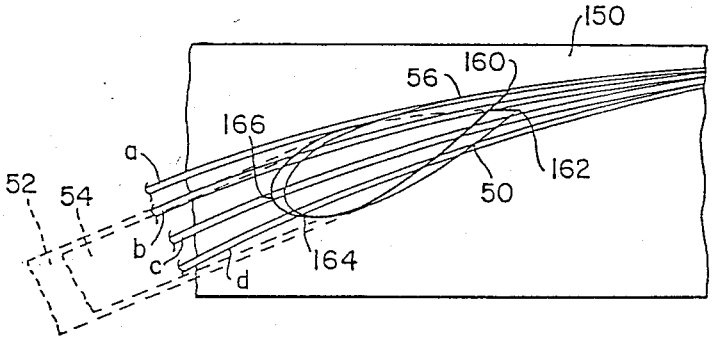
Figure 7C:
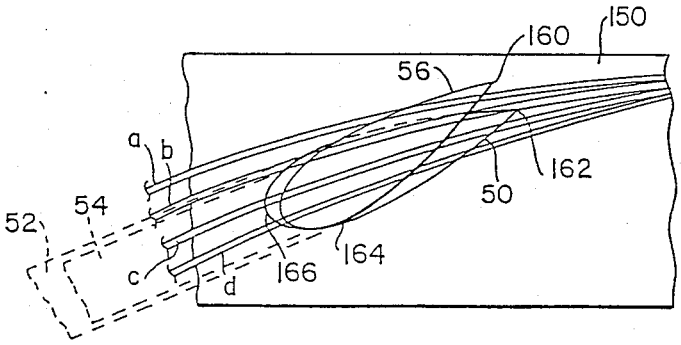

The third position noted in FIG. 7*c* further exaggerates the above-noted principles wherein a greater degree of lighter or less dense particles traveling in stratum a would be received by conduit 54 and a lesser degree of heavier or more dense particles traveling in stratum d would be received. Although the above analysis was conducted with respect to rotation of sidearm conduit 54, the longitudinal movement axially along the axis of sidearm housing 52, by conduit 54 achieves substantially the same results because the housing and conduit are angled towards the truncated apex of the frustoconical member. In this manner, the sidearm conduit is a moveable means for receiving different strata of the slurry passing through the radially outer sectors of the cylindrical region. The conduit is moveable such that the strata received therein is selectable in accordance with the position of the conduit within the side outlet.

Figure 8:
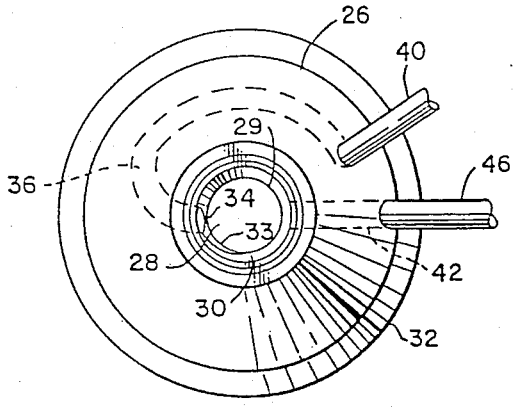
FIG. 8 is a radial end view of the vortex finder.

FIG. 8 illustrates a radial, axially inward end view of vortex finder 26. Clearly illustrated in FIG. 8 is vortex side port 34 in the transition region of taper 30 proximate vortex intake 29 and the spiral path of side port passageway 36. The vortex side port is substantially aligned with the tangential streamlines extending from the streamlines of flow within the vortex finder proximate to intake 29. Additionally, a guide lip 33 extends from intake 29 to vortex side port 34 in a partial spiral.

The operation of cyclone separator 10 begins with the injection of slurry via input conduit 22 and inlet port 24. A swirling movement is developed within cylindrical region 16 and particles are separated into strata in the radially outer sectors of cylindrical region 16, i.e., in close proximity to interior surface 150. Some of the strata of particles traveling along surface 150 are extracted based upon the position of intake portion 56 of sidearm conduit 54. Generally, the separation into strata is based upon particle density. A free vortex, substantially spirally shaped, is established in the radially outer sectors of cylindrical region 16 and frustoconical region 18 and is generally directed towards the apex of the frustoconical region. Stokes law affects the particles traveling in the slurry, and the larger size particles generally move to the radially outermost portions of the particular region, whereas the smaller particles are "dragged along" with the flow of fluid. A forced vortex, substantially spirally or helically shaped, is established in the radially inward sectors of the frustoconical region and that forced vortex travels in a direction back towards the base of the frustoconical region and the cylindrical region. A first portion of particles is extracted via the lower outlet 64 by action of the free vortex. Generally, the particles entrained in the free vortex are larger than the particles entrained in the forced vortex. The forced vortex travels back towards the cylindrical region 16 and ultimately enters intake 29 of vortex finder 26.

In the embodiment illustrated herein, taper 30 of vortex finder 26 accelerates the velocity of the free vortex entering the intake thereto and hence accelerates the particles therein. The heavier particles in that free vortex move, by Stokes law, to the radially outermost sectors of that defined cylindrical space and are extracted via vortex side port 34, passageway 36, exit port 38 and vortex side port conduit 40. Outer taper 32 reduces the amount of fluid from input port 24 escaping into the overflow via vortex intake 29. In this embodiment, the quality of particles within the extracted forced vortex, obtained via passage 28 of vortex finder 26, is very controllable due to the controllable positioning of the sidearm conduit, the controllable size of the lower outlet port and the degree of taper in taper 30. In one field test, the following separation factors were obtained: input slurry at 150 psi, flow rate 700 gal/min. $d_{50}=100$ microns particle size; overflow extracted from vortex finder longitudinal passage 28, $d_{50}=4$ to 10 microns particle size; sideflow extracted from sidearm conduit 54, $d_{50}=70$ to 100 microns particle size; underflow extracted via lower outlet 64, $d_{50}=120$ micron particle size; and vortex side port flow extracted from vortex side port conduit 40, $d_{50}=15$ to 20 micron particle size. These field test results were obtained when the sidearm conduit was in the first position, i.e., flush with interior surface 150. It was estimated that if the sidearm conduit was counterclockwise rotated 30°, a particle range of $d_{50}=40$–80 microns could be extracted via that conduit, whereas a 30° clockwise rotation produces a particle range of $d_{50}=80$–150 microns. These results presented herein are exemplary only but the results do show a comparison between the particle ranges extracted with cyclone 10.

As recognized by a person of ordinary skill in the art, an air core develops along the longitudinal axis of the forced vortex. When the slurry is contaminated drilling mud, a vacuum pump can be mounted above vortex finder 26 to evacuate the air core and extract dissolved oxygen within the contaminated mud which is driven into the air core by the dynamic forces within cyclone separator 10.

With respect to control system 12 schematically illustrated in FIG. 1, a person of ordinary skill in the art recognizes that by establishing a desired particle parameter, such as particle density, controller 114 can utilize lookup tables to determine the proper setting of traveling cone valve 62 in lower outlet 64, and the proper positioning of the sidearm conduit set by driver means 84. In this particular situation, selected strata of particles would be extracted via sidearm conduit 54 since cyclone separator 10 generally separates particles in accordance with density within cylindrical region 16 and separates particles in accordance with particle size in frustoconical region 18. However, if the operator of cyclone 10 desires a particular particle size to be extracted from the slurry via the output of vortex finder 26, a desired particle size is input into control system 12 via input means 112, controller 114 utilizes lookup tables to establish the positioning of traveling cone 62 in lower outlet 64 and the sidearm conduit 54 position to effect the size of the particle entrained within the forced vortex. Of course, a person of ordinary skill in the art recognizes that the pressure of the slurry injected via input conduit 22 greatly effects the operation of the entire system. Therefore, particle parameters of the input slurry are analyzed by analyzer 90 and this information is taken into account by controller 114. Further, it may be desirable to obtain a certain type of particle via the vortex side port conduit 40 following the above procedure.

Figure 9:
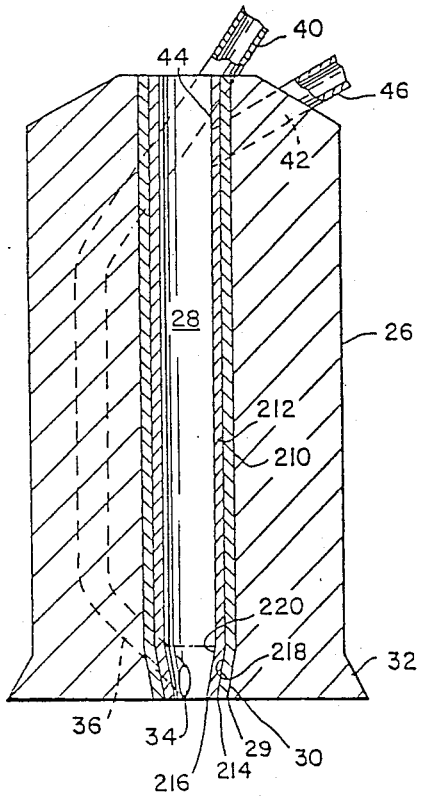
FIG. 9 is a cross-sectional, axial view of the vortex finder with a plurality of insertable cones therein.

FIG. 9 illustrates an alternate embodiment of vortex finder 26. The illustrated vortex finder in FIG. 9 is substantially similar to the vortex finder illustrated in FIG. 1 except that insert cones 210 and 212 have been inserted into longitudinal passage 28. In this manner, the vortex intake can be made smaller and hence the amount of the forced vortex entering passage 28 is restricted. In other words, insert 210 corresponds to intake 214 and insert 212 corresponds to intake 216. Intake 216 has a smaller cross-sectional area as compared with intake 214. In a similar fashion, insert 210 has taper 218 whereas insert 212 has taper 220. The transition between taper 220 and the longitudinal passage defined by insert 212 is at an axially outboard position relative to the transition between tape 218 and the longitudinal passage defined by insert 210. In this manner, the acceleration of the fluid accepted by the vortex finder is changed based upon the degree of taper and the angle of the taper of the insert. Of course, inserts 210 and 212 must have passages or cutouts therein to match vortex side port 34 to passageway 36. In a similar manner, inserts 210 and 212 must have some type of apertures therein to match sampling passage 42 with sampling port 44.

Figure 10:
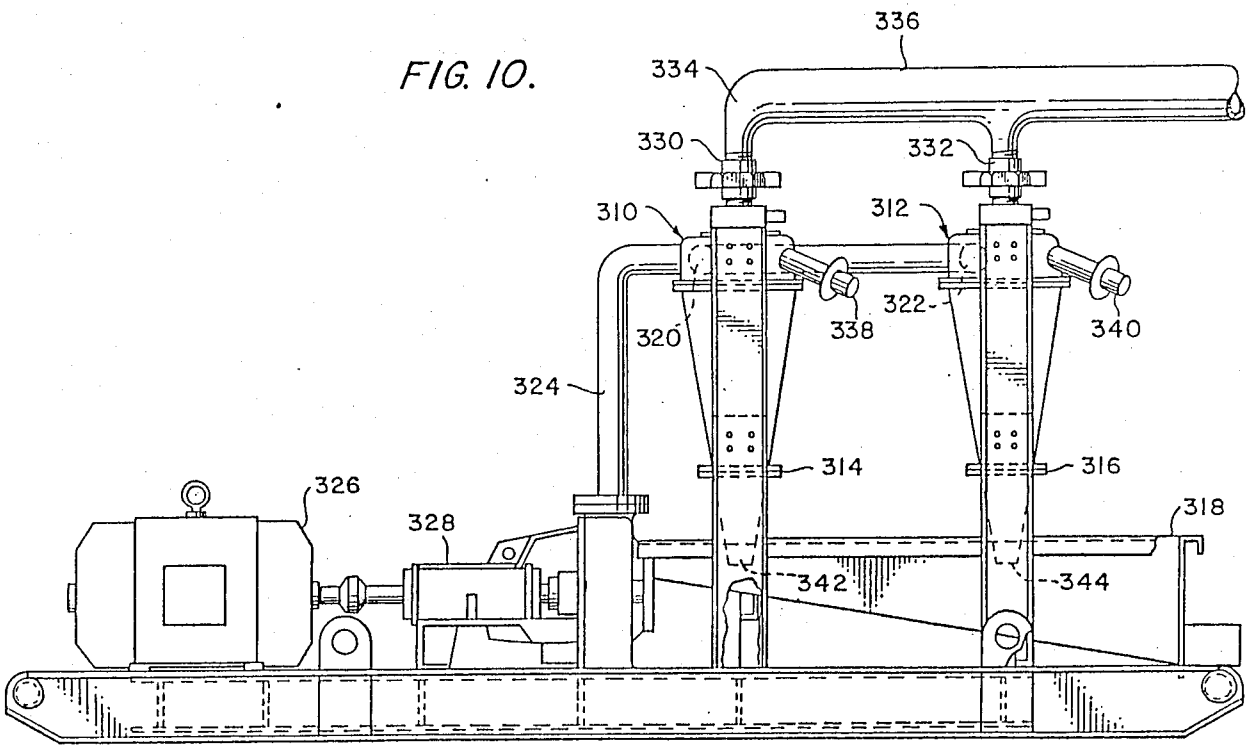
FIG. 10 is a pair of cyclone separators mounted on a sled with associated components; and, FIG. 11 is a schematic of the cyclone separator including an inner vortex finder tube, a secondary forced vortex outlet line, and a frustoconically shaped, lower outlet head.

FIG. 10 illustrates a pair of cyclone separators. Cyclone 310 and cyclone 312 are mounted on supports 314 and 316, respectively, above a tank 318. Input ports 320 and 322 are coupled to supply line 324 and to cyclones 310 and 312, respectively. Motor 326 provides motive power to pump 328 which pumps the slurry through supply line 324 to cyclones 310 and 312. In this particular embodiment, supply line 324 links both cyclones 310 and 312. Therefore, cyclones 310 and 312 are coupled in parallel to each other. The overflow or "purified" slurry extracted via the vortex finder outlet is supplied to inlets 330 and 332 coupled to cyclones 310 and 312, respectively. A wide angle elbow 334 is coupled to inlet 330 to reduce the back pressure on the air core and to allow the overflow to be only minimally disrupted by the bend in output pipe 336. Sidearm conduits 338 and 340 extending outward from cyclones 310 and 312, respectively, and can be coupled to any further filtering or processing device as recognized by a person of ordinary skill in the art. Alternatively, the extracted fluid can be recycled into the cyclones. Underflow via lower outlets 342 and 344 of cyclones 310 and 312, respectively, are in close proximity to tank 318. In this particular embodiment, cyclones 310 and 312 do not include a vortex side port to extract the heavier particles entrained within the forced vortex extracted by the vortex finder.

Figure 11:
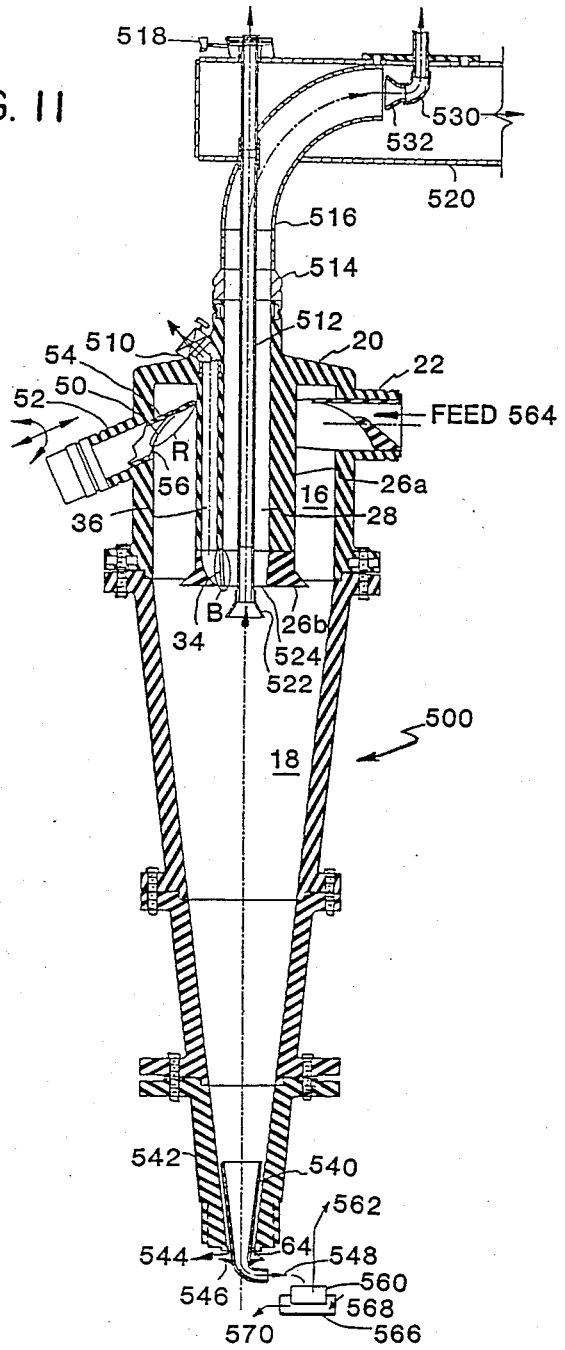

Another embodiment of the invention is illustrated in FIG. 11 as cyclone separator 500. Like numerals identify similar components in cyclone separator 500 as noted above with respect to the other embodiment illustrated in FIG. 1 as cyclone separator 10. A portion 26*a* of vortex finder 26 is an integral part of sealing member 20. The axially inboard portion 26*b* of the vortex finder is affixed to portion 26*a*. Sidearm intake 56 of sidearm conduit 54 has a streamlined geometric shape identified as R in FIG. 11. The geometric shape of side port 34 is designated B in that figure. The flow of slurry through the output of side port passageway 36 is controlled by valve 510.

Cyclone separator 500 includes inner forced vortex tube 512 which is coaxially disposed within passage 28 of vortex finder 26. Inner tube 512 extends through coupler 514 and output pipe 516 which is coupled to the upper outlet port of vortex finder 26. Inner tube 512 is controllably positioned axially inboard or axially outboard of cyclone separator 500 by adjustment mechanism 518 atop overflow outlet chamber 520.

Axially inboard, inner tube 512 includes a frustoconically shaped intake head 522 with the base of the frustoconical shape of the intake head opening towards the apex of frustoconical region 18. Intake head 522 can be shaped similar to the streamlined shape R of sidearm intake 56 or be shaped similar to shape B of vortex finder side port 34. The streamlined shape allows efficient pickup of fine and light material from the radially inner sectors of the forced vortex. With a streamlined shape, the turbulence near this intake head is reduced and fine and light material with platy shapes and low frictional values and highly plastic materials are efficiently extracted from the forced vortex. Particle sizes d50 approximately equal to 0.5 to 3.0 micron fine and light material near the air core of the forced vortex can be separated from the balance of the forced vortex. The coarser fraction of the overflow product, the balance of the forced vortex, enters vortex finder take 524. By axially positioning intake 522 via adjustment mechanism 518, the particle size of the particles extracted or separated from the forced vortex is changed.

A secondary forced vortex outlet 530 is disposed at the output of output pipe 516. The secondary forced vortex outlet is adapted to remove light and fine particles from the overflow discharge, the portion of the slurry passing through the vortex finder, from the other portion of the overflow passing through output chamber 520. The secondary forced vortex outlet 530 includes frustoconical intake 532 coaxially disposed at the output of output pipe 516.

At the apex of frustoconical region 18, a frustoconically shaped lower outlet head 540 is coaxially disposed proximate the lower housing portion 542 of the cyclone separator. Lower outlet head 540 is also spaced from housing portion 542 and lower outlet 64 such that underflow reject portion 544 passes therethrough. In one embodiment, the underflow reject portion entrains particles having a particle size d50 of approximately 30 microns. A reject plate deflector 546 assists the ejection of underflow reject 544. Lower outlet head 540 separates out desirable underflow 548 and the desirable underflow is further separated by separator 560 wherein part of the desirable underflow is separated out as portion 562 which can be separated oxide particles which are further sent to storage or waste or recirculated back to cyclone separator 500 via slurry feed 564 and the other separated portion of the desired underflow 548 is placed in holding chamber 566. Wet or dry magnetic concentrator 568 can be added to holding chamber 566 to separate out hematite, magnetite or other oxides or particles from the slurry system. Slurry portion 570 can be placed in storage, in waste or recirculated to feed 564. In one embodiment, desirable underflow 548 has a particle size d50 approximately 1 to 20 micron, and is semicoarse material such as concentrated heavy barite, hematite or other known materials.

The shape of lower outlet head 540 can be streamlined similar to shape R or B to conform with the streamlines of flow in the free vortex. The streamline shape of lower outlet head reduces the turbulence and collects materials efficiently. The space between lower outlet head 540 and housing portion 542 is a variable annulus. The size of the annulus depends upon the positioning and shape of lower outlet head 540.

In one embodiment, when a portion of the forced vortex is extracted via inner tube 512, valve 510 from side port passageway 36 is closed. The closure of the valve affects the overall distribution of particles passing through passage 28 of vortex finder 26. A person of ordinary skill in the art recognizes that various valves can be added to this system which would affect the particle distribution in the extracted slurry portions taken from the many outputs in cyclone separator 500. Also, adjustment means 518 can include a motor which varies the axial position of intake head 522 or inner tube 512 in accordance with an appropriate control signal. Therefore, the axial position of intake head 522 can be controlled dependent upon the sample of the particles analyzed by analyzer 90 illustrated in FIG. 1.

The claims appended hereto are meant to cover all modifications and substitutions readily apparent to those of ordinary skill in the art. One modification readily apparent to such a person relates to incorporating a mechanism to alter the axial position of side port 50. In such a situation blocking means selectively limits the axially upper (or lower) extent of the side port and hence affects the strata received by the sidearm conduit.

What is claimed is:

1. A cyclone particle classifier comprising:

a housing defining a generally cylindrical region and a substantially frustoconical region therebelow with its apex extending away from said cylindrical region;

a tangential inlet port means for introducing a fluid slurry into said cylindrical region;

an elongated hollow vortex finder disposed in said housing and having a substantially coaxial passage therethrough with its bottom opening toward said apex of said frustoconical region;

exit means at said apex of said frustoconical region and at the top of said coaxial passage of said vortex finder;

moveable means positioned on said housing for removing different strata of said fluid slurry passing through the radially outer sectors of said cylindrical region dependent upon the position of said moveable means for removing;

an inner forced vortex tube disposed within said coaxial passage of said vortex finder and having a opening towards said apex of said frustoconical region, said inner tube adapted to remove a portion of the slurry in the forced vortex to the exterior of said body.

2. A cyclone particle classifier as claimed in claim 1 including means for controlling the axial position of said opening of said inner tube.

3. A cyclone particle classifier as claimed in claim 2 wherein the opening of said inner tube includes a frustoconically shaped intake head with the base of said frustoconical shape opening towards said apex of said frustoconical region.

4. A cyclone particle classifier as claimed in claim 3 wherein said vortex finder includes a vortex side port in communication with said coaxial passage and includes a side port passageway substantially longitudinally extending from said vortex side port through said elongated vortex finder said side port passageway having an exit port to the exterior of said housing.

5. A cyclone particle classifier as claimed in claim 4 including a frustoconically shaped lower outlet head coaxially disposed and spaced from the lower outlet which is part of said exit means at said apex of said frustoconical region and spaced from the portion of said housing proximate to said apex of said frustoconical region.

6. A cyclone particle classifier as claimed in claim 5 including a secondary forced vortex outlet means for removing a portion of the slurry in said forced vortex, said secondary forced vortex outlet being disposed in said exit means of said coaxial passage and adapted to remove said portion of the forced vortex slurry passing through said exit means of said coaxial passage.

7. A cyclone particle classifier as claimed in claim 5 including means for stopping the flow of slurry through said side port passageway of said vortex finder.

8. A vortex finder substantially disposed within the interior of a cyclone particle classifier, said interior defining a cylindrical region atop the base of a frustoconical region, the vortex finder comprising:

a substantially cylindrical elongated body defining a substantially coaxial passage, the top of the elongated body being open to the exterior of said cyclone classifier beyond said cylindrical region and opposite said frustoconical region, the bottom of the coaxial passage being open to said interior of said cyclone classifier and open towards the apex of said frustoconical region;

a vortex side port in communication with said coaxial passage;

a side port passageway extending from said vortex side port substantially longitudinally through said elongated body and having an exit port to the exterior of said body;

an inner forced vortex tube disposed within said coaxial passage having a opening towards said apex of said frustoconical region, said inner tube adapted to extract a portion of the slurry in the forced vortex and remove the same to the exterior of said body.

9. A vortex finder as claimed in claim 8 wherein the opening of said inner tube includes a frustoconically shaped intake head with the base of said frustoconical shape opening towards said apex of said frustoconical region.

10. A vortex finder as claimed in claim 9 wherein said vortex side port is proximate to the bottom opening of said vortex finder.

11. A vortex finder as claimed in claim 10 wherein said elongated body includes a radially outward extending tapered flange in close proximity to the axially inboard portion of said elongated body.

12. A vortex finder as claimed in claim 11 including a secondary forced vortex outlet means for removing a further portion of the slurry in said forced vortex, said secondary forced vortex outlet being disposed at the exit of said elongated body and adapted to remove said further portion of said slurry passing through said coaxial passage.

13. A vortex finder as claimed in claim 12 including means for stopping the flow of slurry through said side port passageway.

14. A cyclone particle classifier for controllably separating out and classifying particles fluidly suspended in a slurry comprising:

a housing defining a generally cylindrical region and a substantially frustoconical region therebelow with its apex extending away from said cylindrical region;

a tangential inlet port means for introducing the fluid slurry into said cylindrical region;

an elongated hollow vortex finder disposed in said housing having a substantially coaxial passage therethrough, the bottom of said coaxial passage being open toward said apex of said frustoconical region;

means for controllably extracting first and second portions of said slurry at said apex of said frustoconical region and at the top of said vortex finder via said coaxial passage respectively;

moveable means oontrollably positioned on said housing for removing different strata of said fluid slurry passing through the radially outer sectors of said cylindrical region dependent upon the position of said moveable means for removing;

an inner forced vortex tube disposed within said coaxial passage of said vortex finder and having a opening towards said apex of said frustoconical region, said inner tube adapted to remove a third portion of the slurry to the exterior of said housing;

a vortex side port in communication with said coaxial passage and a side port passageway substantially longitudinally extending from said vortex side port through said elongated vortex finder, said side port passageway adapted to pass a fourth portion of said slurry to the exterior of said housing;

controllable means for stopping the flow of said fourth portion of said slurry through said side port passageway;

means for analyzing a parameter of the particles entrained within the extracted first, second, third and fourth portions of said slurry and the removed strata obtained via said moveable means for removing and for generating first, second, third, fourth and fifth parameter signals; and control means for positioning said moveable means for removing dependent upon a comparison between one of said first, second, third, fourth and fifth parameter signals and a desired particle parameter.

15. A method of separating particles fluidly suspended in a slurry comprising the steps of:

providing a defined cylindrical region and a frustoconical region with the base of said frustoconical region adjoining one axial end of said cylindrical region;

injecting said slurry under pressure into said cylindrical region and establishing a swirling movement therein;

controllably extracting a first portion of said slurry and strata of particles entrained therein at the radially outermost sectors of said cylindrical region;

establishing a free vortex and a forced vortex of said slurry at least within said frustoconical region;

removing a second portion of said slurry at said apex of said frustoconical region; and removing a fourth, fifth and sixth portion of said slurry and the entrained particles therein from said forced vortex.

16. A method as claimed in claim 15 including the step of defining a substantially cylindrical space within at least said cylindrical region, said cylindrical space being concentric with said cylindrical region; said removal of said fourth portion occurring at the radially inwardmost sector of said forced vortex, and said removal of said fifth portion occurring at the radially outermost sector of the slurry passing through said cylindrical space.

17. A method as claimed in claim 16 including the steps of:

analyzing parameters of the particles entrained in the extracted and removed slurry portions and providing corresponding parameter signals;

selecting desired particle parameters; and effecting the controllable removal and extraction of slurry portions and the particles entrained therein based upon said desired particle parameters and said parameter signals.

* * * * *